United States Patent [19]

Garberick

[11] 4,332,292

[45] Jun. 1, 1982

[54] COIL CLEANING DEVICE AND SYSTEM

[76] Inventor: Thayne K. Garberick, 3506 S. Michigan St., South Bend, Ind. 46614

[21] Appl. No.: 148,196

[22] Filed: May 9, 1980

[51] Int. Cl.[3] ..... F28G 1/16

[52] U.S. Cl. ..... 165/95; 164/112; 239/229

[58] Field of Search ..... 239/70, 229, 551, 562; 134/123, 172; 165/95

[56] References Cited

U.S. PATENT DOCUMENTS

| | | | |
|---|---|---|---|
| 2,601,655 | 6/1952 | Young | 239/229 |
| 2,620,231 | 12/1952 | King | 239/229 |
| 3,773,059 | 11/1973 | Arneson | 134/123 |
| 3,828,570 | 8/1974 | Stutz | 165/95 X |
| 4,040,477 | 8/1977 | Garberick | 165/103 |

FOREIGN PATENT DOCUMENTS

| | | | |
|---|---|---|---|
| 1806634 | 5/1970 | Fed. Rep. of Germany | 239/229 |

*Primary Examiner*—Andres Kashnikow
*Attorney, Agent, or Firm*—Marmaduke A. Hobbs

[57] ABSTRACT

A coil cleaning device and system for spraying a pressurized cleaning medium against the coil to dislodge the dirt therefrom, in which a plurality of the devices are arranged in front of the coil and operate either simultaneously or individually. Each device includes a flexible hose section connected at one end to a relatively rigid supply line from a medium supply source, and to a nozzle at the free end. The medium discharged through the nozzle causes the hose to whip about and direct the medium against the coil over a relatively large area.

8 Claims, 7 Drawing Figures

Fig. 3
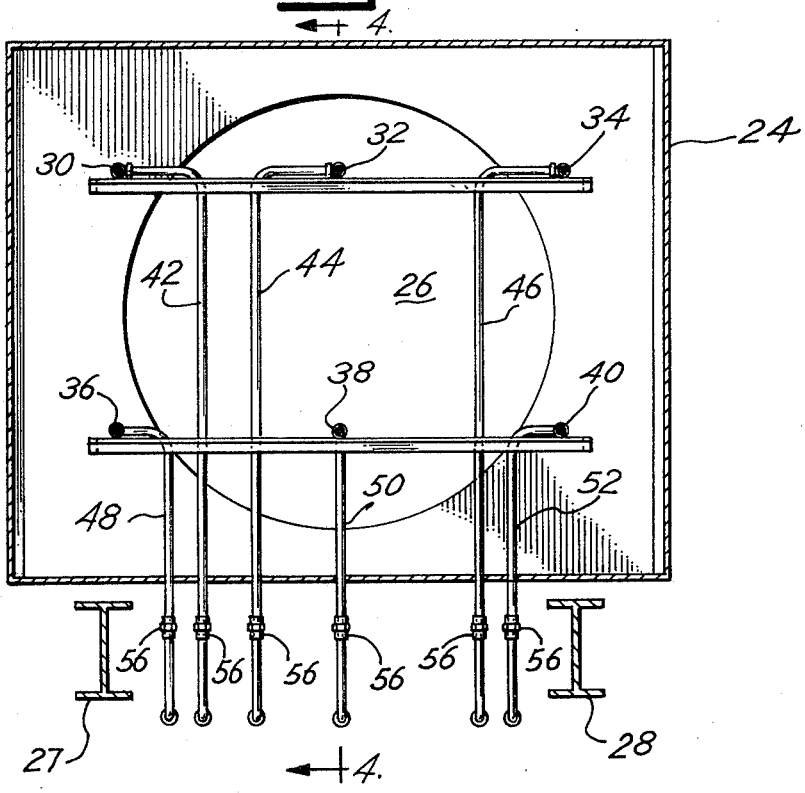
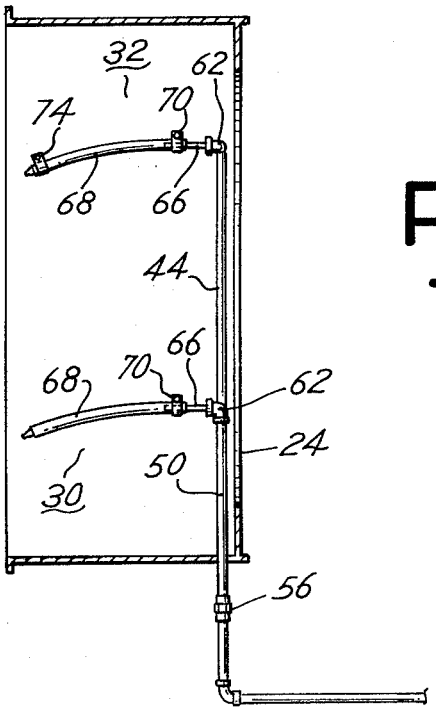
Fig. 4

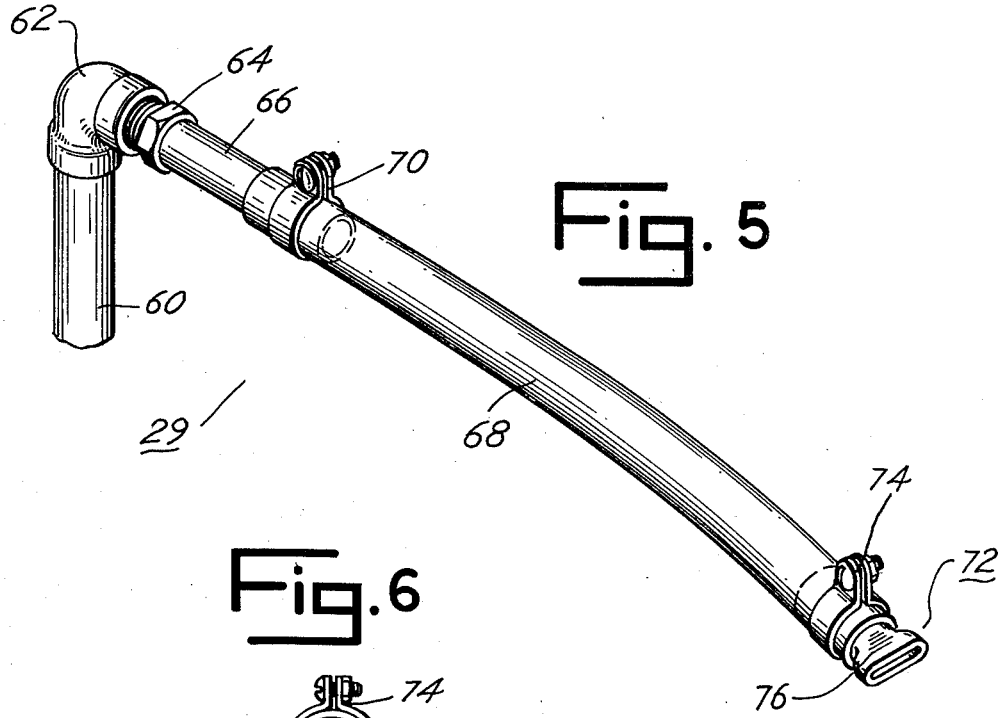
Fig. 5
Fig. 6
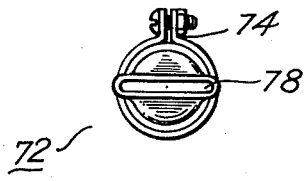
Fig. 7
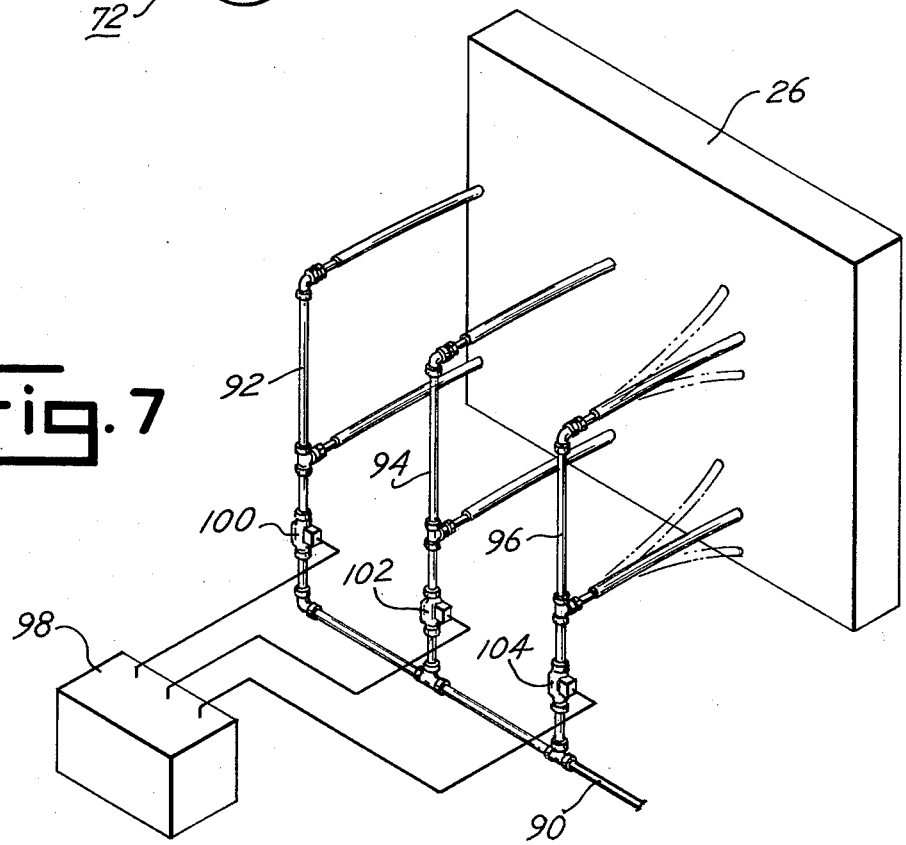

COIL CLEANING DEVICE AND SYSTEM

In conventional air handling systems used in large buildings for interior climate control, and in heat recovery apparatus used to recover heat from the exhaust gases in stacks or flues, coils or heat pipe units may be disposed at several locations in the ducts of the system. For example, there may be a heat pipe or coil unit in the exhaust duct of a heat recovery apparatus which removes heat from the discharged gases of a furnace, heat treating or drying oven, and transfers it to the intake side of the apparatus, to warm the incoming air for space heating systems. Heating coils supplied with hot water from a boiler may be disposed in an air handling system to warm the air to the desired temperature, and chilled water coils, supplied from air conditioning cooling towers, may also be disposed in the system to cool the air for the building when the intake air is warm. The air or exhaust gases passing through the heat recovery apparatus or air handling system flow through and around the various coil banks, heat pipes, or the like to be heated or cooled as necessary, or to heat or cool the refrigerant in the coil, to achieve the desired temperature for the air supplied to the building.

Normally the coils in a heat recovery apparatus will include a plurality of heat tubes connected to and/or supported by metal fins which aid in the heat absorption from the exhaust gases and the heat dissipation into the intake air. As the exhaust gases pass through the exhaust ducts, being diverted from the stack or flue by a blower, the gases, together with the normal exhaust residue and contaminants, flow between the fins and around the tubes of the coil. Many of the dirt particles being carried by the exhaust gases are deposited on the tubes and fins, and as the deposits increase, an insulating coating builds up on the tubes and fins, which can retard the transfer of heat between the exhaust gases and the medium in the tubes. Excessive accumulation on the tubes and fins may restrict the air flow as well as retard heat transfer. The coil or coils disposed within the air intake duct may become covered with dust, insects or leaves, since even though screens and filters may be used, some dirt may pass therethrough.

Large buildings may have a number of individual air handling systems for supplying air to different zones in the building; hence, there may be a large number of coils in the overall ventilation system. Each coil comprises a system of interconnected, relatively small diameter tubes in spaced relation, but in close proximity, to each other. This arrangement provides a large surface area for the transfer of heat between the medium flowing through the coils and the air forced by fans through the ducts. Although filters and screens are disposed in the system to trap dust, dirt, insects and the like, the high volume of air passing through the ducts retains some contaminants and often deposits much of the contaminants on the coils. The accumulation of dirt and the like on the coils produces the same undesirable effects on the air handling system as the dirt accumulation on coils in the exhaust system. The dirt acts as an insulating material, thereby restricting the transfer of heat between the medium in the coils and the air flowing through the coils. Hence, chilled water temperatures must be lowered, and hot water temperatures must be elevated, to provide sufficient cooling or heating of the air when the coils become dirty. A second problem which arises when the coils become dirty is that the spaces through which the air flows become smaller, thus either lowering the volume of air supplied by the system, or increasing the load on the fans causing them to work harder than when the coils are clean.

For these and other reasons, it is desirable to clean the coils frequently, before the dirt accumulation becomes significant. The cleaning is performed either with brushes to rub the dirt off, with pressure lines to blow the dirt off, or with vacuum cleaners to suck the dirt from the coils. Each of these methods requires at least one person to physically perform the cleaning operation, and the procedure can be time consuming, in that the coils are often difficult to clean properly and may be located in places where access thereto is not convenient. Heat recovery apparatus are normally located above the roof of a building, which can complicate the cleaning procedure. To clean the coils or heat pipe units manually, the heat recovery apparatus must be turned off, to permit a workman to enter the exhaust duct, hence wasting energy as otherwise recoverable heat passes through the stack and into the atmosphere. Thus, cleaning is often postponed or ignored until the heat recovery units accumulate large amounts of dirt, and the air handling efficiency of the system is greatly impaired. When the coils are dirty, large amounts of energy can be wasted in heating and cooling large buildings. Many of these same problems are associated with the screens and filters on the intake side of the air handler system which may become clogged with insects, dirt, leaves and the like, thereby restricting entrance of air to the air handling system. It is therefore one of the principal objects of the present invention to provide a cleaning device and system which may be used to clean coils, heat pipes, screens and the like, to remove dirt and other contaminants therefrom, and which can be installed permanently to provide a frequent, regular, and systematic cleaning of the coils or screens before the dirt accumulation thereon becomes significant.

Another object of the present invention is to provide a cleaning device and system which can be automated to provide regular and systematic cleaning of coils or other surfaces without the need for manual operation of the system, and which has an adjustable cycle to alter the cleaning as required by environmental conditions and conditions of the air handling system.

A further object of the present invention is to provide a coil cleaning device and system which has relatively few mechanical parts, thereby substantially reducing the possibility of system malfunction, and which is simple and durable in design and construction to withstand inclement weather or other adverse operating conditions.

Still another object of the present invention is to provide a coil cleaning device and system which is inexpensive to manufacture and install, and can be incorporated into existing air handling systems, heat recovery units, and the like without substantial modification to either the cleaning system or the air handler, and which can be installed to clean hard to reach places where human access is difficult.

A still further object of the present invention is to provide a cleaning device and system which is versatile in operation and design to meet the particular needs of the device on which it is installed, which can clean a large surface area with a relatively small source of cleaning medium, and which can be constructed to perform the cleaning operation with a variety of different cleaning media.

Additional objects and advantages of the present invention will become apparent from the following detailed description and the accompanying drawings wherein:

FIG. 3 is a cross sectional view of the air handler and cleaning system shown in FIG. 2, taken on line 3—3 of the latter figure;

FIG. 4 is a vertical cross sectional view of the coil assembly and cleaning system shown in FIG. 3, taken on line 4—4 of the latter figure;

FIG. 5 is a perspective view of one of the coil cleaning devices used in the system of the present invention;

FIG. 6 is an elevational view of one end of the cleaning device; and

FIG. 7 is a perspective view of a modified embodiment of the present invention showing the operation of the system by broken lines.

Figure 1:
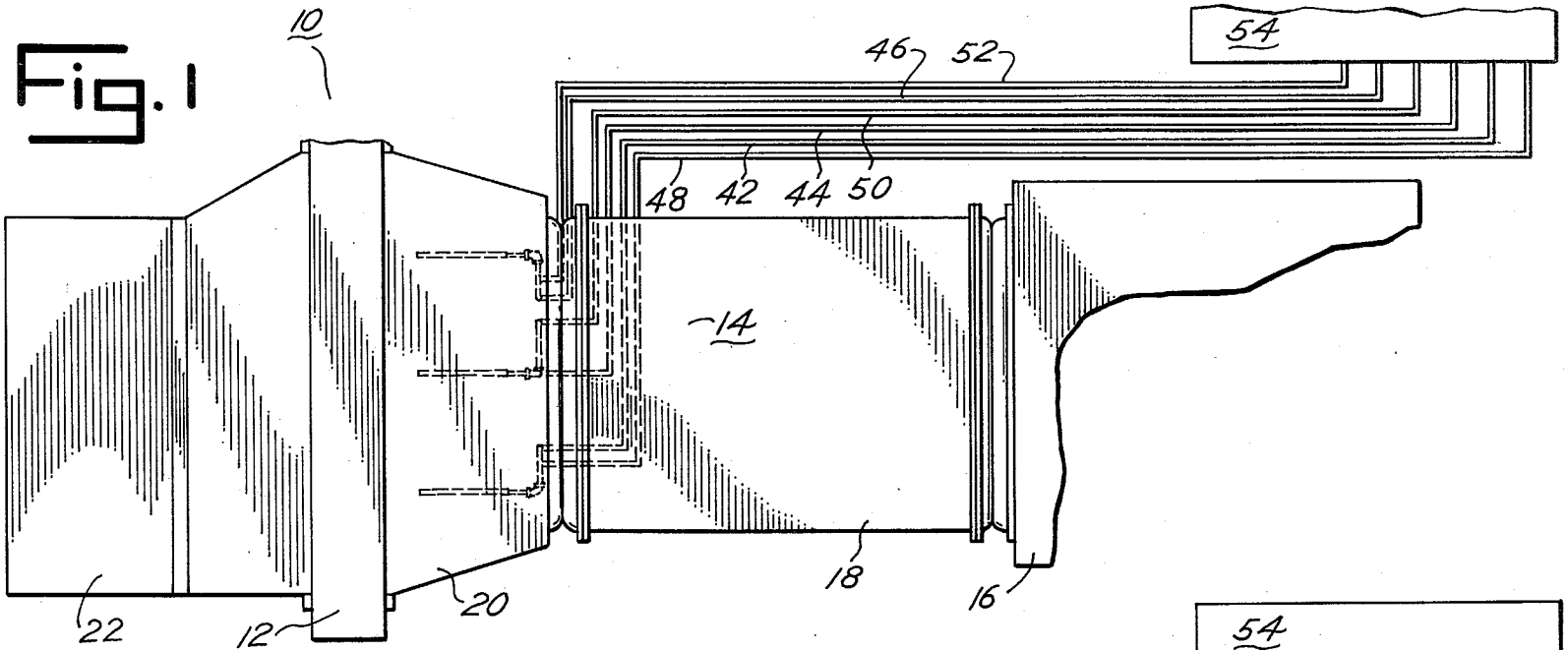
FIG. 1 is a fragmentary view of the top of an air handling system having a coil cleaning system embodying the present invention installed therein.
Figure 2:
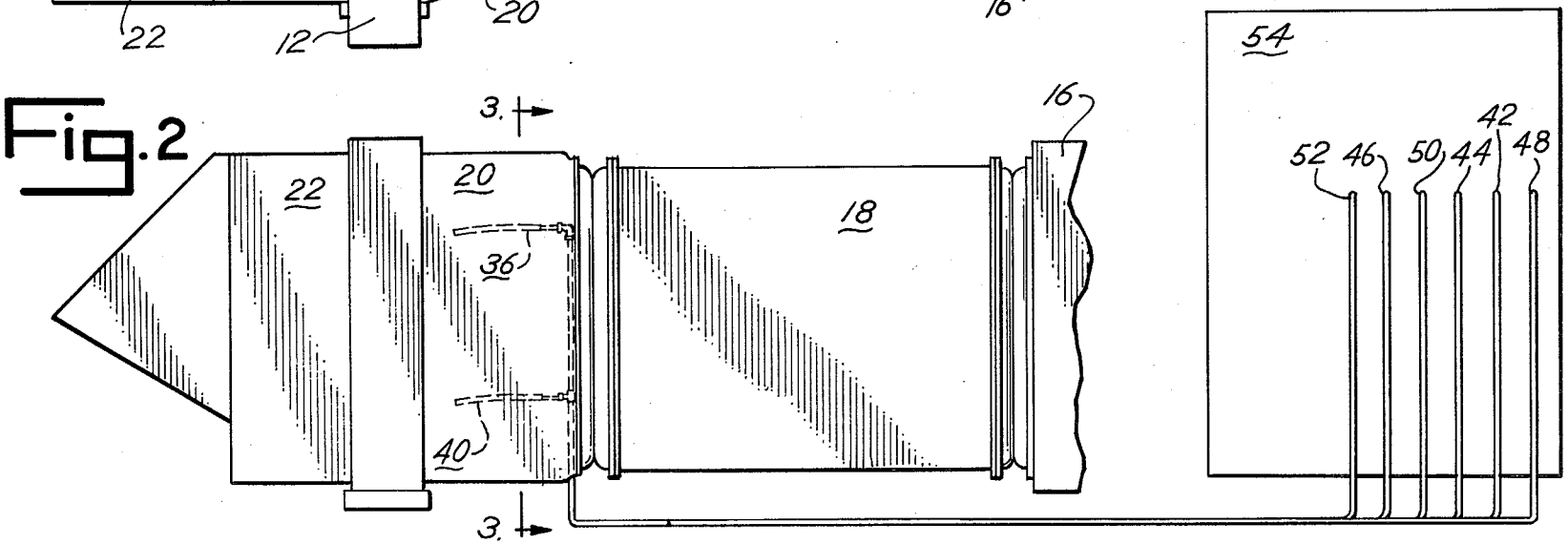
FIG. 2 is a side elevational view of the air handler and coil cleaning system shown in FIG. 1.

Referring more specifically to the drawings, and to FIG. 1 in particular, numeral 10 designates an air handler having a coil assembly 12 with a coil cleaning system 14 embodying the present invention for periodically cleaning dirt, insects, or other accumulation from the coil. The device and system to be described will operate effectively to clean various types and sizes of coils, and may be used to clean heat pipe units, screens, plates or other surfaces used on equipment other than air handlers.

Air handler 10 is of conventional construction and the cleaning system of the present invention can be installed in existing climate control systems or in newly constructed systems with only minimal modification of the systems. Hence, the construction of air handler 10 is of common knowledge to those in the art and includes duct sections 16, 18, 20 and 22 interconnected to form a passageway for the transfer of air to, or from the building interior. Coil assembly 12 is positioned within the passageway formed by the ducts, and includes a housing 24 and a coil 26 supported by I-beams 27 and 28. The air flowing through the passageway flows around and between the individual tubes of the coil which may contain a circulating fluid to absorb heat from hot gases from a furnace or the like in one type of installation, or to heat or chill the air in the duct in another type of installation. The air handler may also include fans, humidifiers, filters and the like which are not shown.

Coil cleaning system 14 includes a plurality of cleaning devices, an example of which is shown in FIG. 5 and designated with the numeral 29. The devices are positioned within duct 20 in an arrangement whereby substantially all of the coil can be cleaned by the devices. The number and arrangement of the devices may vary, depending upon the size of the coil and the length of the device. System 14, shown in FIGS. 1 through 4, includes an upper row of devices having individually operating devices 30, 32 and 34, and a lower row having devices 36, 38 and 40. The devices have supply lines 42, 44, 46, 48, 50 and 52 that connect each device to a cleaning medium supply source 54 which provides a pressurized cleaning medium to the devices. The medium may be air, liquid, or liquids containing solvent or the like, depending upon the surface being cleaned and the system in which it is located. Supply source 54 will be a pressure fluid tank, air compressor, or the like, appropriate for the cleaning medium to be used, and contains controls for regulating the operation of the system, to start and stop the cleaning cycle as desired. The control mechanisms may be manually operated switches or valves requiring physical operation of the system; however, preferably the supply source will contain automatic controls, such as conventional timer activated switches and the like, so that the cleaning cycles will be controlled automatically. Thus, regular, periodic cleaning of the coil is provided, which does not rely on the availability of a maintenance worker for operation. The supply lines may be fed simultaneously from source 54, or may be fed in cycles so that only one or two will be performing the cleaning function at a given time.

Each of the supply lines has a union 56 connecting the supply line to a riser section of the line. The plumbing fixtures used and the means for arranging the supply lines are those commonly used in the plumbing, piping and conduit fields. Thus, though threaded pipe type plumbing is shown, it should be understood that flare or solder plumbing may be used, as well as plastic pipe plumbing or even glass pipe plumbing. The type of tubing or pipe used for the supply lines will depend upon the conditions in which it will function as well as the type of cleaning medium or solvents used. Each of the devices 30, 32, 34, 36, 38 and 40 is similar to device 29 shown in FIG. 5, and the subsequent description of device 29 is equally applicable to all of the devices. Device 29 has a supply line 60 which terminates in an elbow fitting 62. A reducer 64 is attached to the elbow and has a pipe section 66 extending therefrom. A hose 68 or other type of flexible tube is disposed on pipe section 66 and is secured thereto by a clamp 70. The hose may be rubber or other material; however, it should be highly flexible. A nozzle 72 is disposed in the free end of hose 68 and is secured therein by a clamp 74. A nozzle with a substantially flattened area 76 having an elongated, relatively narrow slot 78 therein, works well to provide an active whipping action of hose 68 as the pressurized medium passes therethrough. Other nozzle configurations may be used, and in some applications devices without nozzles may be suitable if sufficient medium pressure is provided for the desired action of the device. The length of hose 68 and the pressure and volume of medium determine the area which each of the devices will clean. A longer hose, when whipping about because of the pressurized medium escaping through the nozzle, will cover a larger area than will a shorter hose.

In the installation and use of a coil cleaning system embodying the present invention, a suitable location is found for supply source 54, and the supply lines are extended from the supply source to the general area of the coil or surface to be cleaned. The number and height of supply lines and riser sections are determined by the area to be covered by the cleaning system and the length of hose 68 which will be used. Thus, the devices are arranged so that the area covered by each individual hose 68, during the whipping action thereof, will overlap slightly with the adjacent areas covered by other devices, thus covering substantially the entire surface of the coil. As the pressurized cleaning medium escapes through nozzle 72 the flexible hose 68 begins to whip randomly around, and the medium escaping through the nozzle is directed to different areas of the coil or surface being cleaned, and will dislodge the dirt from the surface. In a heat recovery apparatus of the type previously mentioned, the present cleaning system will normally be placed so that the cleaning medium will pass through coil 12 in the same direction as the flow of the exhaust gases. The dislodged dirt will be sufficiently fragmented to pass through the coil and will be carried by the exhaust gases out of the recovery apparatus. Filters may be used to collect the dirt, or environmentally tolerable amounts may be discharged with the exhaust gases into the atmosphere. For cleaning some apparatus it is desirable to place the cleaning system so that the cleaning medium will pass through the coil, screen, or the like in the opposite direction of the normal air flow. Hence, with respect to the coils and screens in air intake ducts, the reverse flow of the cleaning medium will dislodge leaves, insects and dirt from the coils and/or screen.

A modification of the cleaning system is shown in FIG. 7, wherein a single supply line 90 feeds separate pairs of cleaning devices 92, 94 and 96. The cleaning devices of the system, including hoses 68 and nozzles 72, are the same as that previously described; however, in the system shown in FIG. 7 a timer/sequencer 98 is connected to valves 100, 102 and 104 to alternately open and close the valves. Only two of the devices will be operating at one time, in that only one of the valves 100, 102, 104 will be opened while the remaining two are closed, and a smaller capacity supply source may be used than if a greater number of devices were simultaneously operated. Hence, by using a timer/sequencer arrangement, relatively large surface areas may be cleaned utilizing only a small pressurized medium supply source, which will not require a substantial amount of space in the building for the installation. A single supply source can be used to operate cleaning systems on several coils which are controlled by timer/sequencers and in some installations it will be possible merely to tap into existing pressure lines to supply the cleaning systems, and the timer/sequencer will control the operation of the system. In these situations the addition of a separate supply source is unnecessary.

The present coil cleaning system and device may be installed in existing air handlers to clean the coils therein, as normally adequate space exists in front of the coil wherein the supply lines and hoses may be installed. The compressor, pressure tank or other pressurized medium supply source may be placed wherever adequate room exists, and appropriate plumbing extended therefrom to the cleaning devices in front of the coils. By using valves operated by a timer/sequencer only a small volume of pressure supplied medium is required. The use of an automatic timer/sequencer eliminates the need for manual operation; thus, regular and periodic cleaning of the coil is provided. The coil can be cleaned frequently, before the accumulation of dirt substantially interferes with the operation of the air handler, thereby enabling the air handler to operate at optimum efficiency at all times. The present cleaning system may be installed in areas wherein human access would be difficult and will effectively clean coils or other surfaces therein. When used in heat recovery apparatus on the exhaust section thereof, it is usually unnecessary to shut the system down to clean the heat pipe units. Any type of solvent may be used which is appropriate for the surface being cleaned, and the dirt being removed therefrom. The system is adaptable to clean various size surfaces in various locations by varying the length, number and arrangement of the devices.

While the present coil cleaning device and system have been described with reference to ventilating and heat recovery systems for buildings, they may have application to other types of fluid flow systems having coils and other surfaces requiring periodic cleaning to remove dirt and other foreign matter deposited thereon. Although one embodiment and modifications thereof have been described in detail herein various other changes may be made without departing from the scope of the present invention.

I claim:

1. In combination with a heat recovery apparatus having a heat exchanger coil for recovering heat from exhaust gases discharged through a stack or flue, a system for cleaning an area of the coil, comprising an elongated flexible member forming a passageway for directing a pressurized cleaning medium against the area of the coil on the upstream side of the coil, one end of said flexible member being secured in a relatively stationary manner and the other end of said member being unsupported, a nozzle disposed in said unsupported end of said member providing a restricted exit from said member, a supply source for providing the pressurized cleaning medium to said member under sufficient pressure to dislodge dirt, soot, and other contaminants from the coil and to cause the contaminants to pass through the coil, and supply lines connecting said supply source to the stationary end of said member.

2. A system as defined in claim 1 in which a plurality of said flexible members having nozzles therein are connected to said supply source and are spaced from one another over substantially the area to be cleaned.

3. A system as defined in claim 2 in which a sequencing means is provided for supplying the cleaning medium to less than all of said members at one time.

4. A system as defined in claim 1 in which said flexible member is a hose.

5. A system as defined in claim 4 in which said nozzle includes a round portion slidable into said hose, and a flattened portion extending out of said hose from said round portion and having an elongated slit therein through which the cleaning medium is sprayed onto the area to be cleaned.

6. A system as defined in claim 2 in which each of said flexible members is a hose, and each of said hoses is disposed generally perpendicular to but spaced from said surface when fully extended.

7. A system as defined in claim 6 in which each of said nozzles includes a round portion slidable into one of said hoses, and a flattened portion having an elongated slit therein forming said restricted exit.

8. A system as defined in claim 7 in which a sequencing means is provided for supplying the cleaning medium to less than all of said members at one time.

* * * * *